US009062573B2

(12) United States Patent
Nakamura

(10) Patent No.: US 9,062,573 B2
(45) Date of Patent: Jun. 23, 2015

(54) VALVE TIMING CONTROLLER

(75) Inventor: Takuji Nakamura, Chiryu (JP)

(73) Assignee: DENSO CORPORATION, Kariya (JP)

( * ) Notice: Subject to any disclaimer, the term of this patent is extended or adjusted under 35 U.S.C. 154(b) by 2 days.

(21) Appl. No.: 13/555,313

(22) Filed: Jul. 23, 2012

(65) Prior Publication Data

US 2013/0036993 A1 Feb. 14, 2013

(30) Foreign Application Priority Data

Aug. 8, 2011 (JP) ..... 2011-173361

(51) Int. Cl.
*F01L 1/34* (2006.01)
*F01L 1/344* (2006.01)

(52) U.S. Cl.
CPC ..... *F01L 1/3442* (2013.01); *F01L 2001/34456* (2013.01); *F01L 2001/34469* (2013.01); *F01L 2001/34483* (2013.01); *F01L 2001/34479* (2013.01)

(58) Field of Classification Search
CPC ..... F01L 1/3442
USPC ..... 123/90.15, 90.17
See application file for complete search history.

(56) References Cited

U.S. PATENT DOCUMENTS

| | | | | |
|---|---|---|---|---|
| 6,338,323 | B1 * | 1/2002 | Machida | 123/90.17 |
| 6,619,248 | B1 * | 9/2003 | Bertelshofer et al. | 123/90.15 |
| 8,651,077 | B2 * | 2/2014 | Matsunaga | 123/90.17 |
| 2004/0182342 | A1 * | 9/2004 | Nakajima | 123/90.17 |
| 2010/0075765 | A1 * | 3/2010 | Isenberg et al. | 464/160 |
| 2010/0116233 | A1 * | 5/2010 | Weisser et al. | 123/90.17 |
| 2010/0015732 | A1 | 6/2010 | Bayeakdar | |
| 2010/0313835 | A1 * | 12/2010 | Yamaguchi et al. | 123/90.15 |
| 2011/0073056 | A1 * | 3/2011 | Kobayashi et al. | 123/90.17 |
| 2013/0036992 | A1 * | 2/2013 | Iwai et al. | 123/90.12 |
| 2013/0180483 | A1 * | 7/2013 | Weisser et al. | 123/90.15 |

FOREIGN PATENT DOCUMENTS

| | | |
|---|---|---|
| JP | 51-65150 | 11/1974 |
| JP | 2002-054408 | 2/2002 |
| JP | 2003-120229 | 4/2003 |

OTHER PUBLICATIONS

Office Action (2 pages), dated Jul. 9, 2013, issued in corresponding Japanese Application No. 2011-173361 and English translation (2 pages).
Office Action issued for Chinese Patent Application No. 201210280739.3 dated Mar. 21, 2014 (with partial English translation).
Office Action issued in Chinese Patent Application No. 201210280739.3 dated Nov. 2, 2014 w/ partial translation).

* cited by examiner

*Primary Examiner* — Zelalem Eshete
(74) *Attorney, Agent, or Firm* — Nixon & Vanderhye P.C.

(57) ABSTRACT

A valve timing controller has a spiral spring biasing a vane rotor in an advance direction. An inner end and an outer end of the spring are respectively engaged with an engage groove and an engage pin in such a manner that a center of a most inner imaginary circle passing through a center line of the wire is apart from a center of a most outer imaginary circle passing through both the center line of the wire and an engage point between the inner end and the engage groove. The most outer imaginary circle is eccentric to the most inner imaginary circle by a specified amount.

3 Claims, 8 Drawing Sheets

VALVE TIMING CONTROLLER

CROSS-REFERENCE TO RELATED APPLICATION

This application is based on Japanese Patent Application No. 2011-173361 filed on Aug. 8, 2011, the disclosure of which is incorporated herein by reference.

TECHNICAL FIELD

The present disclosure relates to a valve timing controller which varies a valve timing of at least one of an intake valve and an exhaust valve according to an engine driving condition.

BACKGROUND

A valve timing controller having a vane rotor adjusts a valve opening/closing timing of at least one of an intake valve and an exhaust valve by varying a differential phase between a camshaft and a crankshaft of an engine. JP-2003-120229A and JP-2009-523943A (US-2010-0154732A1) shows a valve timing controller which is provided with a biasing member biasing a vane rotor to the most advanced position or the most retarded position relative to a housing.

In the valve timing controller shown in JP-2003-120229A, a spiral biasing member biases a vane rotor toward the most advanced position relative to a housing. An inner end of the spiral biasing member is engaged with a groove formed in a boss of the vane rotor. An outer end of the spiral biasing member is engaged with bolts which are provided at two positions of the housing. Since a clearance in the spiral biasing member is relatively large, it is likely that the inner end of the spiral biasing member may be disengaged from the groove or displaced from the original position due to centrifugal force applied to the biasing member. If the inner end of the spiral biasing member is displaced radially outwardly, a torque characteristic of the valve timing controller may deviate from the target torque characteristic.

In the valve timing controller shown in JP-2009-523943A, an inner end of the spiral biasing member is formed in hook-shape to be engaged with a pin provided in a vane rotor. However, since an outer diameter of the spiral biasing member is relatively large to be engaged with the pin, a radial size of the biasing member becomes larger, so that a size of the valve timing controller also becomes larger. Moreover, in addition to a pin for engaging the outer end of the biasing member, an additional pin is necessary to engage the inner end of the biasing member, which may increase the number of parts.

SUMMARY

It is an object of the present disclosure to provide a valve timing controller which is able to restrict a disengagement and a displacement of an inner end of a biasing member with simple configuration.

A valve timing controller is provided in a driving force transmitting system in which a driving force of an internal combustion engine is transmitted from a driving shaft to a driven shaft. The valve timing controller adjusts a valve timing of an intake valve and/or an exhaust valve of an internal combustion engine. The valve timing controller includes a housing, a vane rotor and a biasing member.

The housing includes a cylindrical portion, plate portions closing both ends of the cylindrical portion and an engaging portion provided to one of the plate portions. The plate portions and the cylindrical portion define accommodation chambers in a circumferential direction of the cylindrical portion. The housing rotates along with one of the driving shaft and the driven shaft around a center axis of the cylindrical portion.

The vane rotor includes a cylindrical boss portion accommodated in the housing, a plurality of vanes protruding radially outwardly from the boss portion for dividing each of the accommodation chambers into a retard chamber and an advance chamber, and an engage groove formed on the boss portion in such a manner as to extend radially outwardly. The vane rotor rotates along with the other of the driving shaft and the driven shaft around a center axis of the cylindrical portion in a retard direction or an advance direction relative to the housing according to a hydraulic pressure in the retard chamber and the advance chamber.

The biasing member is spirally shaped by winding a wire. The biasing member is fixed on one of the plate portions in such a manner that its inner end is engaged with the engage groove and its outer end is engaged with the engaging portion. The biasing member biases the vane rotor in the advance direction or the retard direction relative to the housing.

In a case that a most inner imaginary circle passing through a center line of the wire is denoted by C1, a most outer imaginary circle passing through a center line of the wire is denoted by C2, a center of the imaginary circle C1 is denoted by O1, a center of the imaginary circle C2 is denoted by O2, a contact point between the inner end and the engage groove is denoted by p0, and an imaginary line passing through both the center O1 and the point p0 is denoted by L, the inner end and the outer end are respectively engaged with the engage groove and the engaging portion in such a manner that the center O2 is apart from both the center O1 and the point P0, whereby the circle C2 is eccentric to the circle C1 by a specified amount. In a winding direction of the wire, at a vicinity of the line L, specified points are defined in which clearance gaps between these points are less than a specified value. The engage groove and the inner end of the biasing member are located at a vicinity of the specified points.

Therefore, even if a centrifugal force is applied to the inner end of the biasing member, the inner end is hardly displaced by the wire at the specified points. It can be restricted that the inner end is disengaged from the engage groove and the inner end is radially outwardly displaced. Moreover, the torque characteristic hardly deviate from the target torque characteristic. As a result, the operation accuracy of the valve timing controller can be maintained high.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
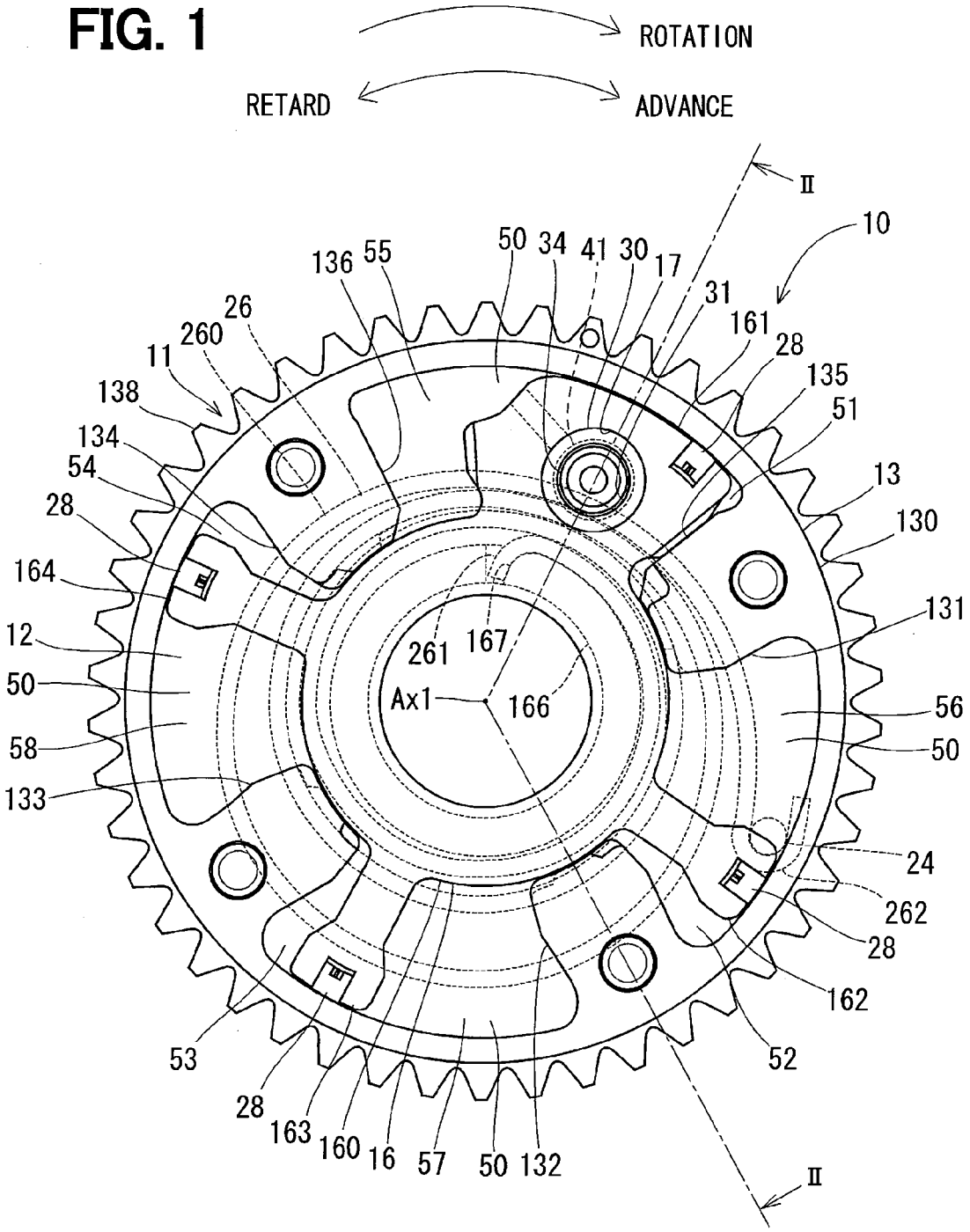
FIG. 1 is a plan view showing a valve timing controller in which a vane rotor is positioned at a most advance position, according to a first embodiment.

Multiple embodiments of the present invention will be described with reference to accompanying drawings. In each embodiment, the substantially same parts and the components are indicated with the same reference numeral and the same description will not be reiterated.

[First Embodiment]

FIGS. 1 to 7 show a valve timing controller according to a first embodiment.

Figure 3:
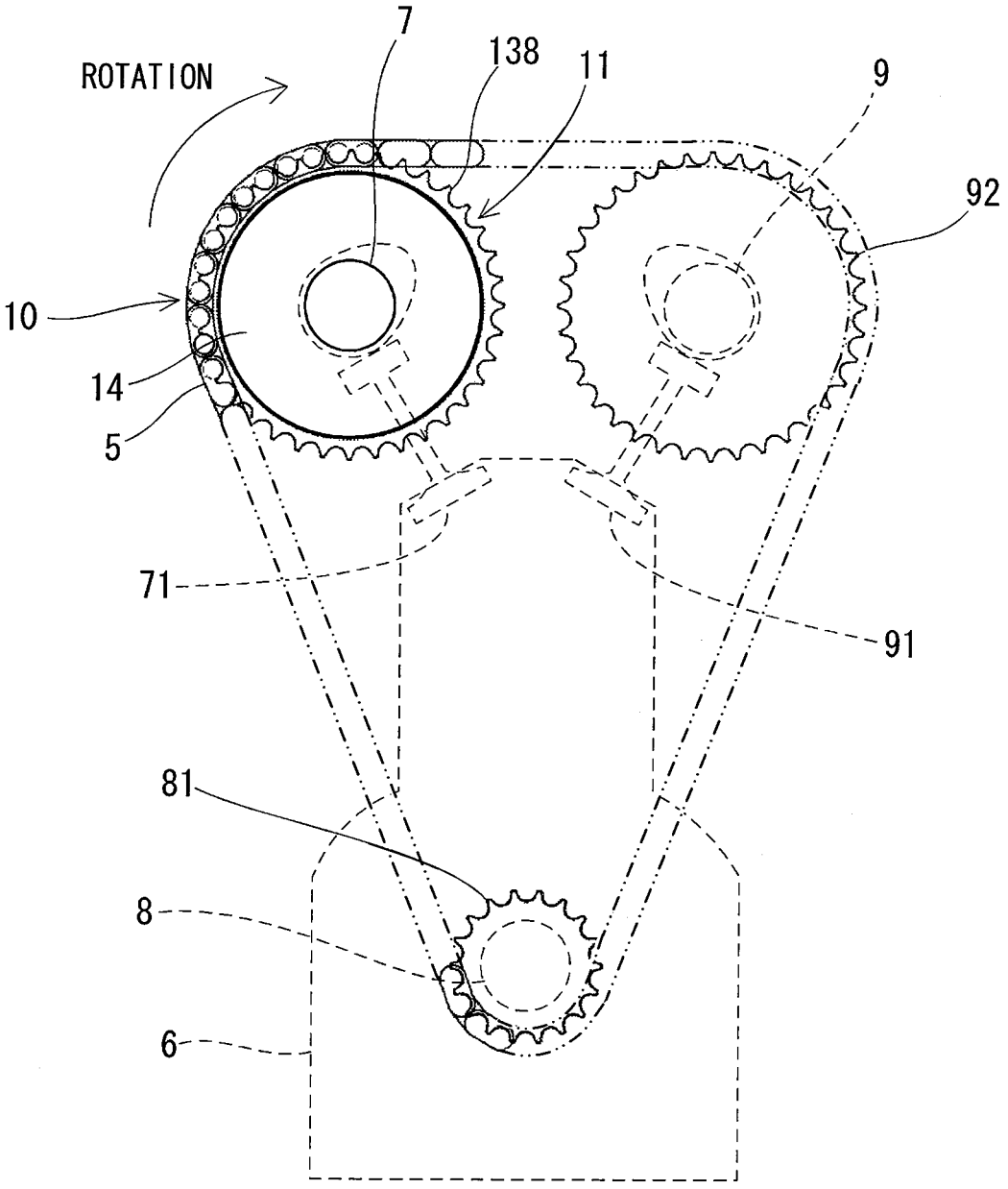
FIG. 3 is a schematic view showing the valve timing controller and its vicinity according to the first embodiment.

FIG. 3 schematically shows a driving force transmission system to which a valve timing controller 10 is applied. An engine 6 has a chain sprocket 81 fixed to a crankshaft 8 as a drive shaft of the engine 6, a gear 138 coaxially connected to a camshaft 7 as a driven shaft, and a chain sprocket 92 connected to a camshaft 9. A chain 5 is wound around the chain sprocket 81, the chain sprocket 92 and the gear 138, whereby a driving force of the crankshaft 8 is transmitted to the camshafts 7 and 9. The gear 138 and a vane rotor 16, which will be described later, configures a part of the valve timing controller 10. The camshaft 7 drives an exhaust valve 71 and the camshaft 9 drives an intake valve 91. The vane rotor 16 is connected to the camshaft 7. The valve timing controller 10 adjust a valve timing of the exhaust valve 71.

Figure 2:
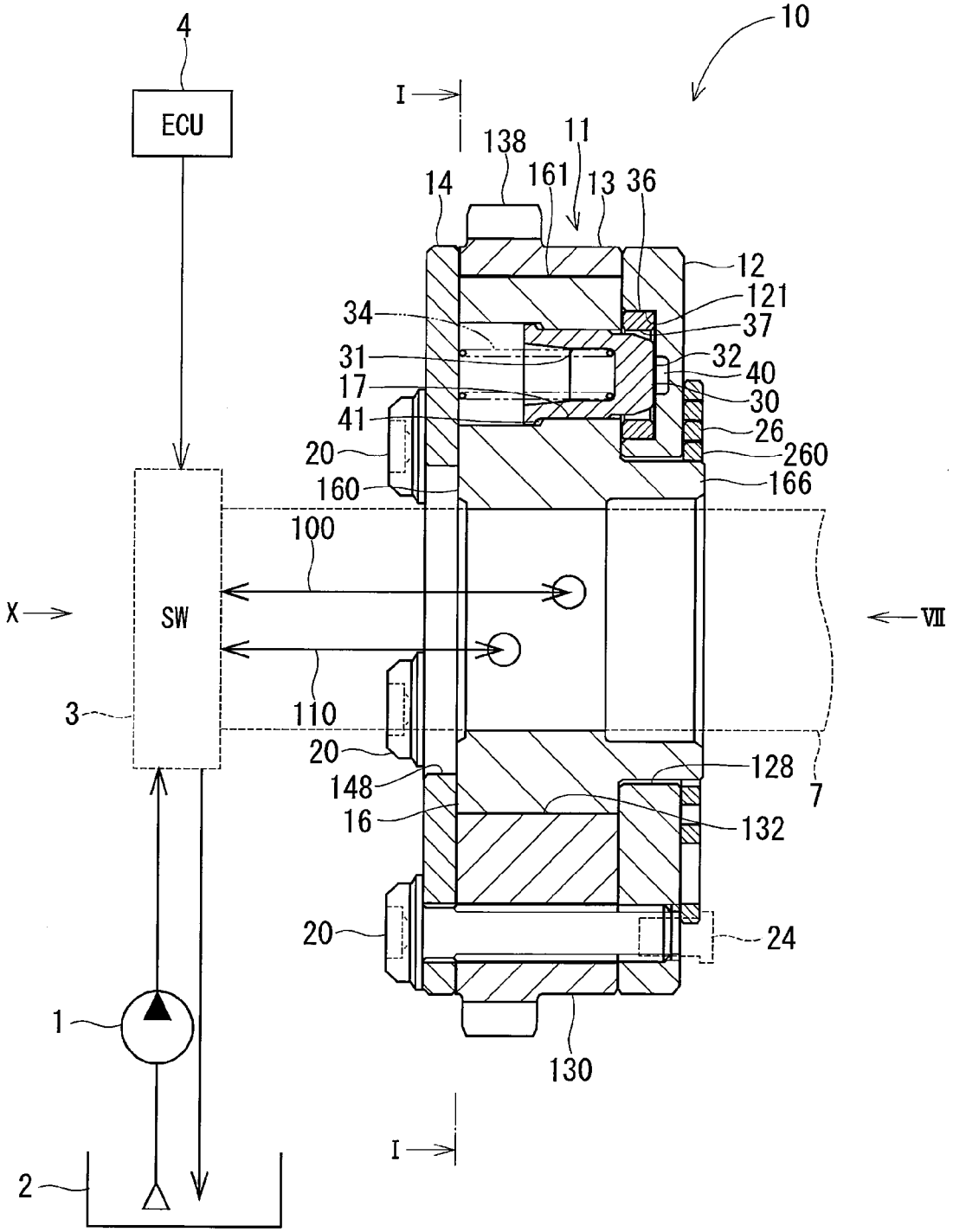
FIG. 2 is a cross-sectional view taken along a line II-II in FIG. 1.

As shown in FIGS. 1 and 2, the valve timing controller 10 is provided with a housing 11, the vane rotor 16 and a spring 26. The housing 11 includes a rear plate 12, a shoe housing 13 and a front plate 14. The rear plate 12, the shoe housing 13, and the front plate 14 are made from metallic material. A bolt 20 is threaded in the rear plate 12 through the front plate 14 and the shoe housing 13, whereby the rear plate 12, the shoe housing 13 and the front plate 14 are coaxially connected to each other. The shoe housing 13 corresponds to a cylindrical portion of the present invention. The rear plate 12 and the front plate 14 respectively correspond to a plate portion of the present invention.

The gear 138 is formed on an outer periphery of the shoe housing 13. The rear plate 12 has a through-hole 128 at its center portion. Also, the front plate 14 has a through-hole 148 at its center portion.

The housing 11 accommodates the vane rotor 16 relatively rotatably. The vane rotor 16 is connected to the camshaft 7 to rotate with. The housing 11, the vane rotor 16 and the camshaft 7 rotate in clockwise direction when viewed along an arrow "X" in FIG. 2. This rotational direction is referred to as an advance direction.

The shoe housing 13 has four shoes 131, 132, 133, and 134 projected inwardly from its peripheral wall 130, as shown in FIG. 1. Adjacent shoes define a fan-shaped accommodation chamber 50.

The vane rotor 16 is made from metallic material. The vane rotor 16 has a cylindrical boss portion 160 and four vanes 161, 162, 163 and 164 projecting radially outwardly from the boss portion 160. The boss portion 160 has an extended portion 166 which extends in the through-hole 128 of the rear plate 12.

The camshaft 7 extends through the through-hole of the rear plate 12, the boss portion 160 and the through-hole 148 of the front plate 14, whereby the valve timing controller 10 is installed to the engine 6.

An outer diameter of each vane 161-164 is less than an inner diameter of the peripheral wall 130 of the housing 13. An outer diameter of the boss portion 160 is less than an inner diameter of the shoe housing 13. Thus, a clearance gap is formed between the vane rotor 16 and the shoe housing 13.

Each of vanes 161, 162, 163 and 164 is rotatably accommodated in the corresponding accommodation chamber 50. Each of the chambers 50 is divided into an advance chamber and a retard chamber by the vane. An advance direction and a retard direction of the vane rotor 16 relative to the housing 11 are indicated by an arrow in FIG. 1. The camshaft 7 and the vane rotor 16 can relatively rotate with respect to the housing 11.

A retard chamber 51 is defined between the shoe 131 and the vane 161, and a retard chamber 52 is defined between the shoe 132 and the vane 162. A retard chamber 53 is defined between the shoe 133 and the vane 163, and a retard chamber 54 is defined between the shoe 134 and the vane 164. An advance chamber 55 is defined between the shoe 134 and the vane 161, and an advance chamber 56 is defined between the shoe 131 and the vane 162. An advance chamber 57 is defined between the shoe 132 and the vane 163, and an advance chamber 58 is defined between the shoe 133 and the vane 164.

As shown in FIG. 2, the boss portion 160 has a retard passage 100 and an advance passage 110. Each retard chamber receives working oil through the retard passage 100 and each advance chamber receives working oil through the retard passage 110.

A switching valve 3 is provided between the retard passage 100 and the advance passage 110. The switching valve 3 is electrically connected to an electronic control unit (ECU) 4. The ECU 4 includes a microcomputer having a CPU, a ROM and a RAM. The ECU 4 operates the switching valve 3 so that the working oil is supplied to one of the passages 100 and 110 and is discharged from the other passage. Thereby, the vane rotor 16 rotates relative to the housing 11 and a differential phase of the camshaft relative to the crankshaft 8 is adjusted.

As shown in FIG. 1, the extended portion 166 has an engage groove 167 which radially outwardly extends. The housing 11 has an engage pin 24 inserted into the rear plate 12. The engage pin 24 protrudes by a specified amount from the rear plate 12 in a direction opposite to the shoe housing 13. The engage pin 24 corresponds to an "engaging portion" and an "engage pin" of the present invention.

The spring 26 is formed by winding a wire 260 into a spiral-shape. The wire 260 is made of metallic material such as iron and stainless steel. In the present embodiment, the wire 260 has a rectangular cross section. The spring 26 is disposed on an outer wall surface of the rear plate 12. An inner end 261 of the spring 26 is engaged with the engage groove 167 and an outer end 262 of the spring 26 is engaged with the engage pin 24. A biasing force of the spring 26 functions as a torque which rotates the vane rotor 16 in the advance direction relative to the housing 11. That is, the spring 26 biases the vane rotor 16 in the advance direction.

When the camshaft 7 drives the exhaust valve 71, the variable torque which the camshaft 7 receives from the exhaust valve 71 varies between positive value and negative value. A positive direction of the variable torque indicates the retard direction of the vane rotor 16 relative to the housing 11, and a negative direction of the variable torque indicates the advance direction of the vane rotor 16 relative to the housing 11. An average torque of the variable torque is the positive direction, that is, the advance direction. The advance torque which the spring 26 applies to the vane rotor 16 is greater than the average torque of the variable torque which the camshaft 7 receives.

As shown in FIG. 1, a seal member 28 is provided on an outer periphery of each vane 161 to 164, respectively. The seal member 28 is made from resin material or metallic material. Each of seal members 28 is biased to an inner wall surface of the shoe housing 13 by a biasing force of a plate spring. Thus, it is avoided that the working oil leaks between the chambers through an outer wall of each vane and an inner wall of the shoe housing 13.

As shown in FIGS. 1 and 2, the vane 161 has a stopper pin 30 as a restricting member. The stopper pin 30 is cup-shaped and is accommodated in a through-hole 17 in such a manner as to move axially. The stopper pin 30 has an accommodating hole 31 in which a spring 34 is accommodated. One end of the spring 34 is engaged with the front end plate 14 and the other end of the spring 34 is engaged with a bottom of the accommodating hole 31.

The rear plate 12 has a press-fit hole 121 in which a ring 36 is press-inserted. The ring 36 has a hole 37 in which an end portion 32 of the stopper pin 23 is inserted. That is, the hole 37 is formed on inner wall of the housing 11 toward the vane rotor 16. The spring 34 biases the stopper pin 30 toward the ring 36. It should be noted that an inner diameter of the hole 37 is greater than an outer diameter of the end portion 32 of the stopper pin 30.

As shown in FIG. 2, when the stopper pin 30 is inserted into the hole 37, the relative phase of the vane rotor 16 relative to the housing 11 is fixed. At this relative phase, the phase of the camshaft 7 relative to the crankshaft 8 is the most appropriate phase to start the engine 6. In the present embodiment, the exhaust valve is most advanced.

A first pressure chamber 40 is formed at a bottom of the press-fit hole 121. The first pressure chamber 40 communicates with the retard chamber 51. A second pressure chamber 41 formed around the stopper pin 30 communicates with the advance chamber 55. The hydraulic pressure in the first pressure chamber 40 and the second pressure chamber 41 are applied to the stopper piston 30 in a direction where the stopper piston 30 is disengaged from the hole 37 of the ring 36.

The shoe 131 has a stopper surface 135 confronting the vane 161. When the valve timing controller 10 is ON, the stopper surface 135 is brought into contact with the vane 161 so that the relative rotation of the vane rotor 16 in the advance direction is restricted. It should be noted that when the vane 161 is in contact with the stopper surface 135, the vane rotor 16 is most advanced, as shown in FIG. 1.

Figure 4:
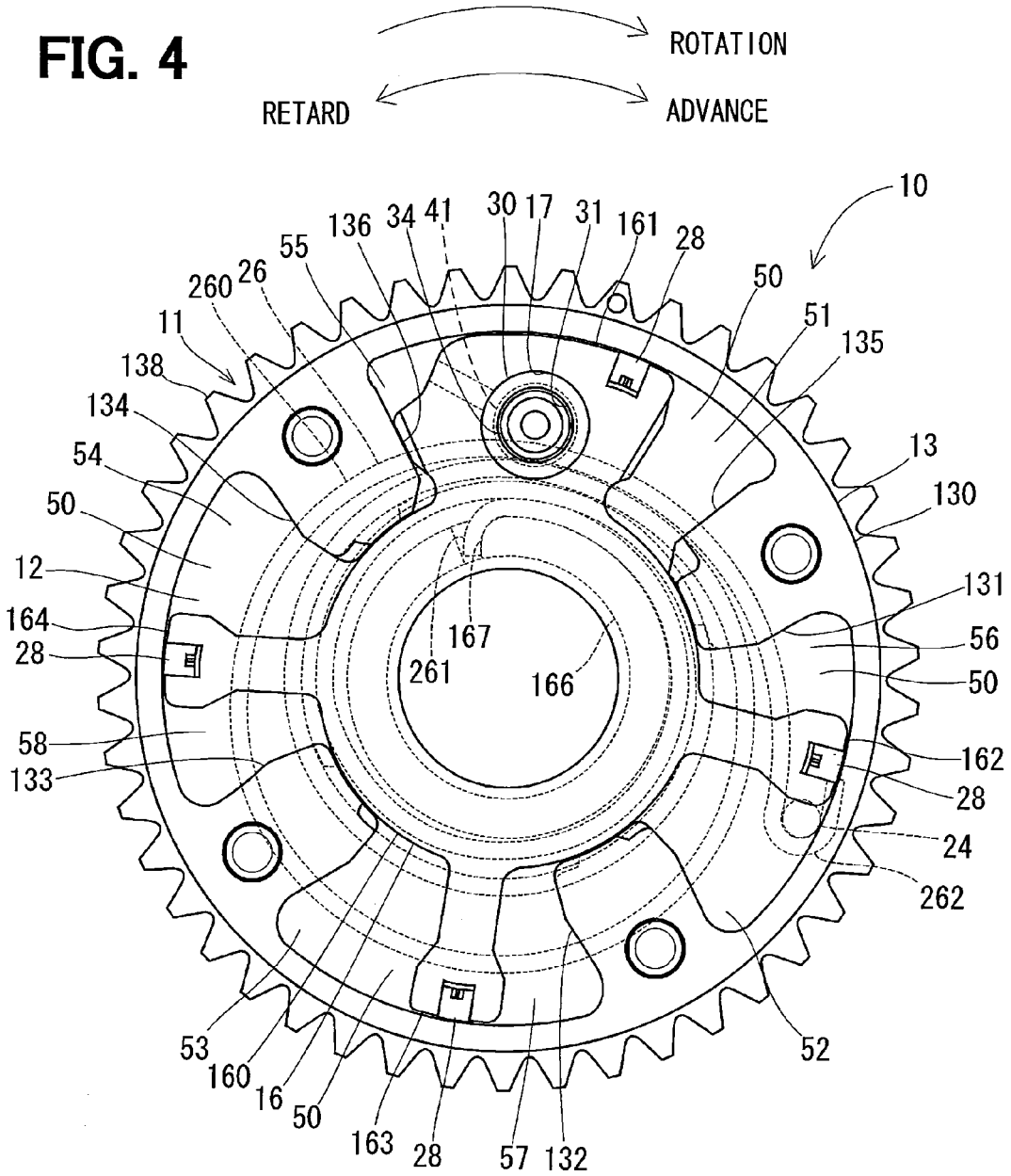
FIG. 4 is a cross sectional view showing the valve timing controller in which a vane rotor is positioned at a most retard position, according to the first embodiment.

Further, the shoe 134 has a stopper surface 136 confronting the vane 161. When the valve timing controller 10 is ON, the stopper surface 136 is brought into contact with the vane 161 so that the relative rotation of the vane rotor 16 in the retard direction is restricted. It should be noted that when the vane 161 is in contact with the stopper surface 136, the vane rotor 16 is most retarded, as shown in FIG. 4.

As above, the vane rotor 16 relatively rotates from a position at which the vane 161 is in contact with the stopper surface 135 to a position at which the vane 161 is in contact with the stopper surface 136. In the present embodiment, a rotational angle range of the vane rotor 16 is about 20°.

Figure 5:
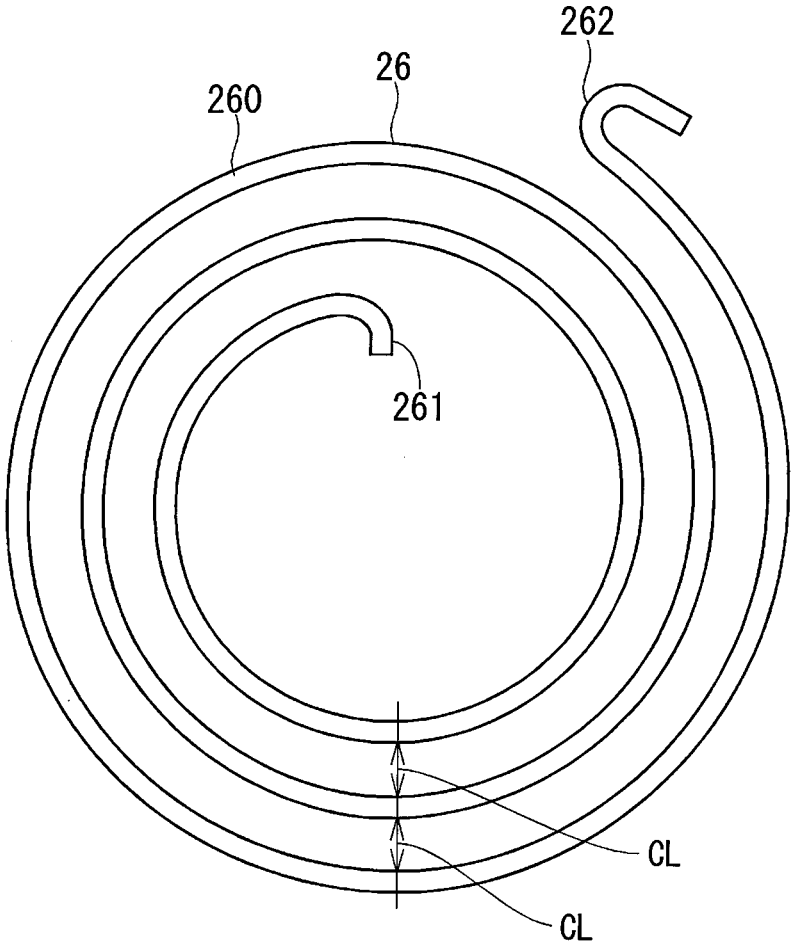
FIG. 5 is a plan view of a biasing member which is in a free state according to the first embodiment.
Figure 6:
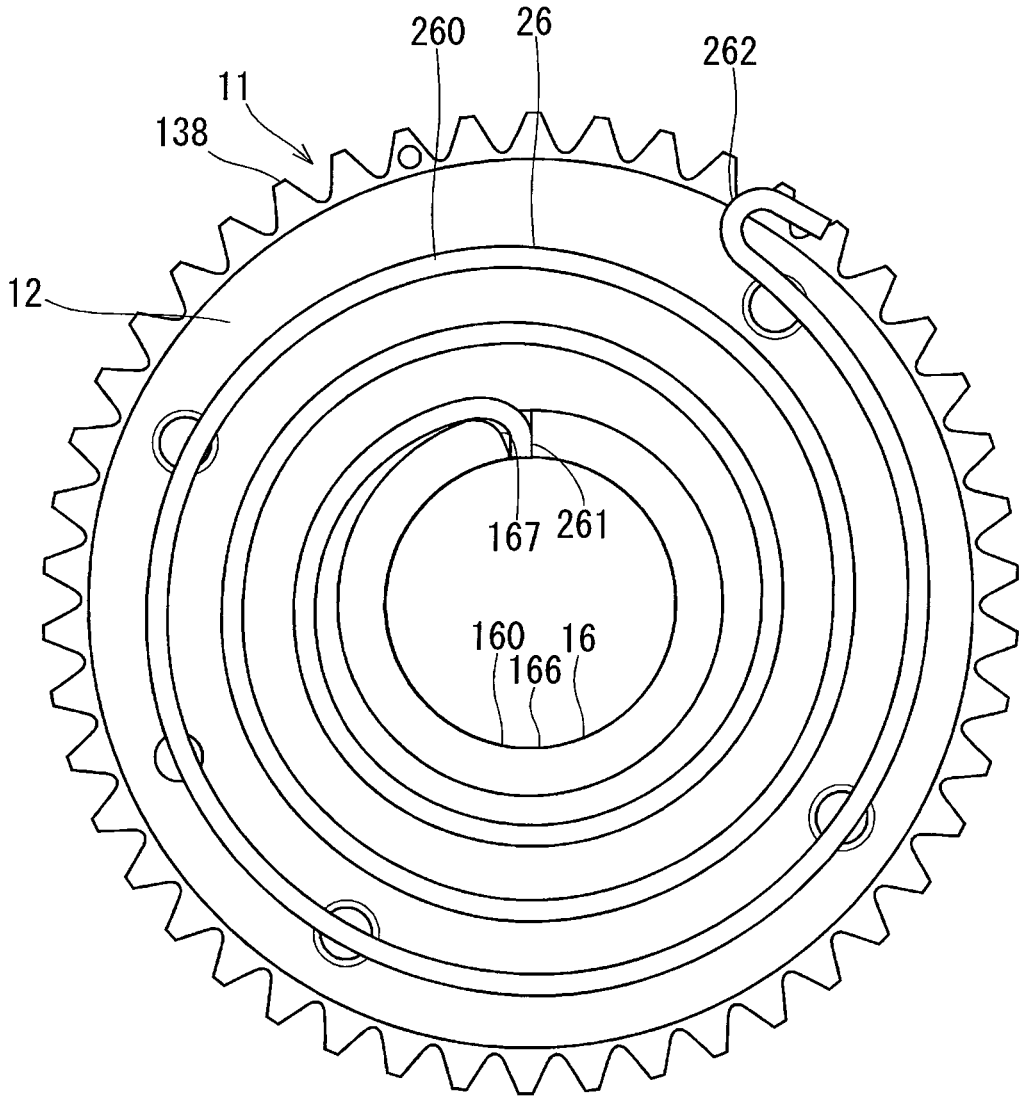
FIG. 6 is a plan view showing a situation in which a biasing member is provided to a housing, according to the first embodiment.

Next, referring to FIGS. 5, 6, and 7, a configuration of the spring 26 and an assembling method of the spring 26 to the housing 11 will be described hereinafter. As shown in FIG. 5, before the spring 26 is assembled to the housing 11, that is, when the spring 26 is in a free state, the wire 260 is wound from its inner end 261 to its outer end 262 in such a manner a clearance "CL" between wire 260 is substantially constant. The inner end 261 of the wire 260 is bent toward a center of the spring 26. The outer end 262 is outwardly hook-shaped.

When assembling the spring 26 to the housing 11, the spring 26 is attached to the rear plate 12 in such a manner that the inner end 261 is engaged with the engage groove 167. FIG. 6 shows the shape of the spring 26 of which inner end 261 is engaged with the engage groove 167.

Then, the engage pin 24 is press-inserted into an insert hole of the rear plate 12. After that, the outer end 262 of the spring 26 is introduced in the advance direction to be engaged with the engage pin 24. Thereby, the spring 26 is fixed to the housing 11, as shown in FIG. 7. At this stage, the spring 26 biases the vane rotor 16 in the advance direction.

Figure 7:
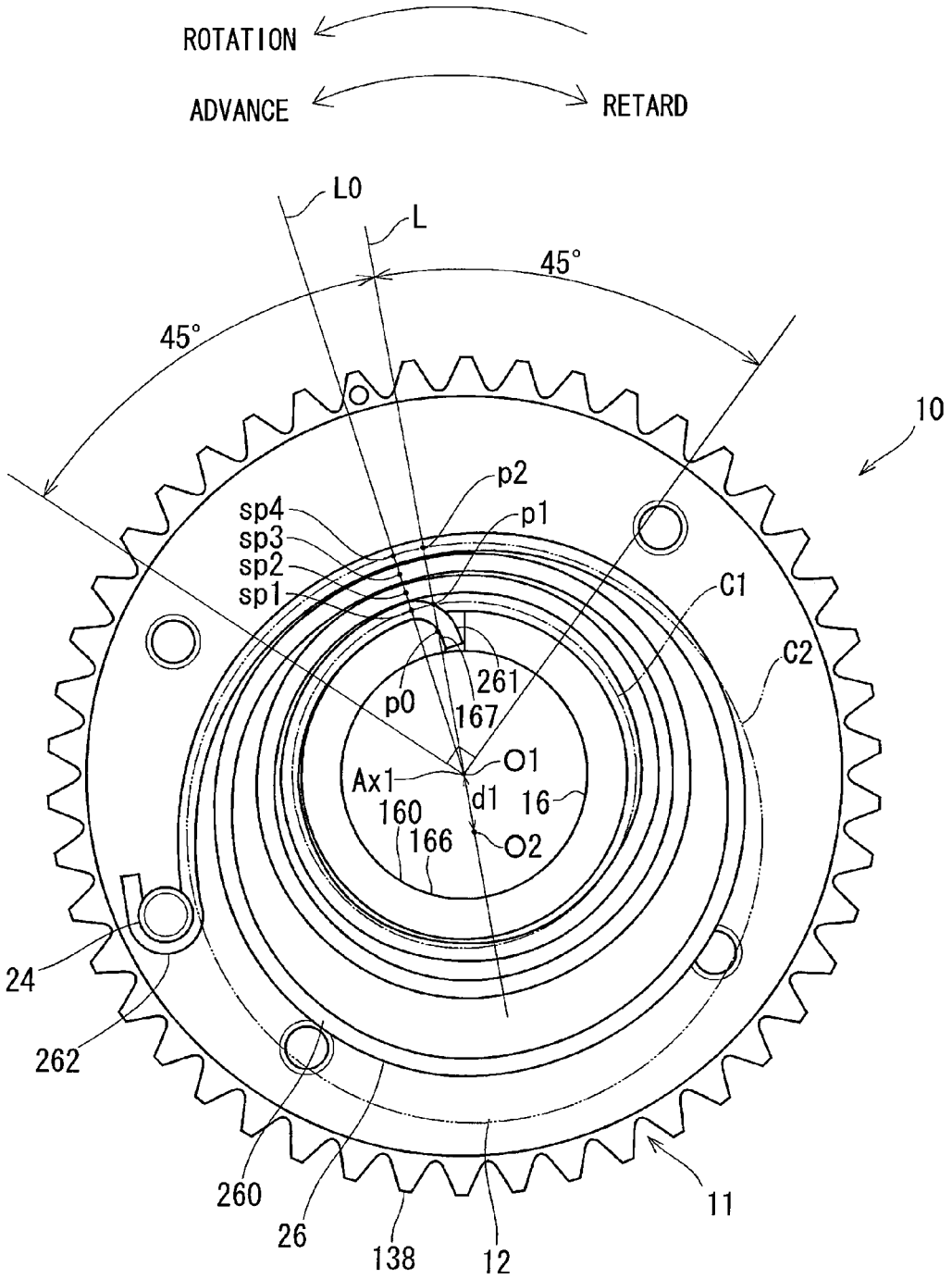
FIG. 7 is a plan view showing a situation in which an outer end of the biasing member is engaged with an engaging portion.

According to the present embodiment, as shown in FIG. 7, a most inner imaginary circle, which is illustrated by a dot-dash-line, passing through a center line of the wire 260 is denoted by "C1", and a most outer imaginary circle, which is illustrated by a two-dots-dash-line, passing through a center line of the wire 260 is denoted by "C2". A center of the imaginary circle "C1" is denoted by "O1" and a center of the imaginary circle "C2" is denoted by "O2". A contact point between the inner end 261 and the engage groove 167 is denoted by "p0". An imaginary line passing through the center "O1" and the point "p0" is denoted by "L". The inner end 261 and the outer end 262 are respectively engaged with the engage groove 167 and the engage pin 24 in such a manner that the center "O2" is apart from the center "O1" and the point "P0", whereby the circle "C2" is eccentric to the circle "C1" by a specified amount "d1". The center "O1" is located on an axis "Ax1" of the boss portion 160. An intersection between the circle "C1" and the line "L" is denoted by "p1" and an intersection between the circle "C2" and the line "L" is denoted by "p2".

In a winding direction of the wire 260, at a vicinity of the line "L", specified points "sp1", "sp2", "sp3" and "sp4" are defined. Clearance gaps between these points "sp1", "sp2", "sp3" and "sp4" are less than a specified value. The engage groove 167 and the inner end 261 of the spring 26 are located at a vicinity of the specified points "sp1", "sp2", "sp3" and "sp4".

FIG. 7 shows a situation where the vane 161 is in contact with the stopper surface 135. That is, the vane rotor 16 is most advanced. In this situation, the specified points "sp1", "sp2", "sp3" and "sp4" are aligned radially outwardly with respect to the boss portion 160. An imaginary line passing through the center "O1" and the points "sp1", "sp2", "sp3" and "sp4" is denoted by "L0". When the vane rotor 16 is most advanced, the line "L0" is positioned at an advance position relative to the line "L". The differential angle between the line "L0" and the line "L" is about 8°.

Moreover, according to the present embodiment, clearance gaps between the points "sp1", "sp2", "sp3" and "sp4" of the wire 260 are substantially zero. That is, in the spiral spring 26, the wire 260 is lightly contact with each other at the points "sp1", "sp2", "sp3" and "sp4". The above eccentric amount "d1" is defined so that the wire 260 is lightly contact with each other at the points "sp1", "sp2", "sp3" and "sp4".

Referring to FIGS. 1 to 4, an operation of the valve timing controller 10 will be described. FIGS. 1 and 2 show the variable timing controller 10 of when the engine 6 is off.

<At Starting of Engine>

When the engine 6 is off, the stopper piston 30 is engaged with the hole 37 of the ring 36, as shown in FIG. 2. At the time immediately after the engine 6 is turned on, enough working oil has not been supplied yet from the oil pump 1 to the retard chambers 51, 52, 53, and 54, the advance chambers 55, 56, 57, and 58, the first pressure chamber 40 and the second pressure chamber 41. The stopper pin 30 is held in the hole 37 of the ring 36, so that the camshaft 7 is held at the most advance position relative to the crankshaft 8. Thus, during a period until the working oil is sufficiently supplied to each chamber, it is avoided that the housing 11 and vane rotor 16 vibrate and collide with each other due to the variable torque which generates beat noise.

<After Engine is Started>

When the engine is started and sufficient working oil is supplied from the oil pump 1 to each chamber, the stopper pin 30 is disengaged from the ring 36 due to the hydraulic pressure in the first and the second pressure chamber 40 and 41. The vane rotor 16 can relatively rotate with respect to the housing 11. The hydraulic pressure in the retard chambers and the advance chambers are controlled, whereby the differential phase between the camshaft 7 and the crankshaft 8 is adjusted.

<Retarding>

The ECU 4 controls the driving current supplied to the switching valve 3. The switching valve 3 is switched so that the oil pup 1 is connected with the retard passage 100 and the advance passage 110 is connected to the oil pan 2. The working oil discharged from the oil pump 1 is supplied to the retard chambers 51, 52, 53, and 54 through the retard passage 100. The hydraulic pressure in the retard chambers 51, 52, 53 and 54 is applied to the vanes 161, 162, 163 and 164, whereby a torque biasing the vane rotor 16 in the retard direction is generated. At this moment, the working oil in the advance chambers 55, 56, 57, and 58 is discharged into the oil pan 2 through the advance passage 110. The generated torque becomes greater than a biasing force of the spring 26, so that the vane rotor 16 rotates in the retard direction relative to the housing 11.

<Advancing>

The ECU 4 controls the driving current supplied to the switching valve 3. The switching valve 3 is switched so that the oil pup 1 is connected with the advance passage 110 and the retard passage 100 is connected to the oil pan 2. The working oil discharged from the oil pump 1 is supplied to the advance chambers 55, 56, 57 and 58 through the advance passage 110. The hydraulic pressure in the advance chambers 55, 56, 57 and 58 is applied to the vanes 161, 162, 163 and 164, whereby a torque biasing the vane rotor 16 in the advance direction is generated. At this moment, the working oil in the retard chambers 51, 52, 53 and 54 is discharged into the oil pan 2 through the retard passage 100. The generated torque and the biasing force of the spring 26 rotate the vane rotor 16 in the advance direction relative to the housing 11.

<Holding the Vane Rotor Position>

When the vane rotor 16 is brought into a target phase, the ECU 4 controls a duty ratio of the driving current supplied to the switching valve 3. The switching valve 3 disconnects between the oil pump 1, the retard passage 100 and the advance passage 110, whereby the working oil is not discharged to the oil pan 2 from the retard chamber 51, 52, 53 and 54 and the advance chamber 55, 56, 57 and 58. For this reason, the vane rotor 16 is held at a target phase.

<At Stopping of Engine>

When an engine stop is commanded while the valve timing controller 10 is operated, the vane rotor 16 is rotated in the advance direction relative to the housing 11. The vane rotor 16 rotates in the advance direction until the vane 161 is brought into contact with the stopper surface 135 and stops at the most advance position, as shown in FIG. 1. In this situation, the ECU 4 turns off the oil pump 1 and the switching valve 3 connects the advance passage 110 and the oil pan 2. Thereby, the hydraulic pressure in the second pressure chamber 41 is decreased, so that the stopper pin 30 moves toward the ring 36 by the biasing force of the spring 34. As the result, the stopper pin 30 is inserted into the hole 37 of the ring 36.

According to the present embodiment, while the valve timing controller is operated, that is, while the vane rotor 16 rotates relative to the housing 11, the engage groove 167 and the inner end 261 of the spring 26 are always positioned at a vicinity of the specified points "sp1", "sp2", "sp3" and "sp4". Therefore, even if a centrifugal force is applied to the inner end 261 of the spring 26, the inner end 261 is hardly displaced by the wire 260 at the specified points "sp1", "sp2", "sp3" and "sp4". It can be restricted that the inner end 261 of the spring 26 is disengaged from the engage groove 167 and the inner end 261 is radially outwardly displaced.

Furthermore, according to the present embodiment, the wire 260 of the spring 26 is lightly contact with each other at the points "sp1", "sp2", "sp3" and "sp4". Thus, the displacement of the inner end 261 can be effectively restricted and an excessive vibration of the spring 26 due to resonance can be restricted.

As explained above, according to the present embodiment, the inner end 261 and the outer end 262 are respectively engaged with the engage groove 167 and the engage pin 24 in such a manner that the center "O2" is apart from the center "O1" and the point "P0", whereby the circle "C2" is eccentric to the circle "C1" by a specified amount "d1". Thereby, in a winding direction of the wire 260, at a vicinity of the line "L", the specified points "sp1", "sp2", "sp3" and "sp4" are defined. The clearance gaps between these points "sp1", "sp2", "sp3" and "sp4" are less than a specified value. The engage groove 167 and the inner end 261 of the spring 26 are located at a vicinity of the specified points "sp1", "sp2", "sp3" and "sp4". That is, in the spiral spring 26, the wire 260 is lightly contact with each other at the points "sp1", "sp2", "sp3" and "sp4". Therefore, even if a centrifugal force is applied to the inner end 261 of the spring 26, the inner end 261 is hardly displaced by the wire 260 at the specified points "sp1", "sp2", "sp3" and "sp4". It can be restricted that the inner end 261 of the spring 26 is disengaged from the engage groove 167 and the inner end 261 is radially outwardly displaced. Moreover, the torque characteristic hardly deviate from the target torque characteristic. As a result, the operation accuracy of the valve timing controller 10 can be maintained high.

Moreover, according to the present embodiment, the inner end 261 of the spring 26 is engaged with the engage groove 167 which is formed on the boss portion 160 of the vane rotor 16. Thus, it is unnecessary to provide an engage pin to be engaged with the inner end 261, whereby the configuration can be simplified.

Moreover, according to the present embodiment, the circle "C2" is eccentric with respect to the circle "C1", whereby the clearance gaps between the he points "sp1", "sp2", "sp3" and "sp4" of the wire 260 are substantially zero. That is, in the spiral spring 26, the wire 260 is lightly contact with each other at the multiple points "sp1", "sp2", "sp3" and "sp4". According to this configuration, a displacement of the inner end 261 is further restricted by the wire 260 at the points "sp1", "sp2", "sp3" and "sp4". Since an excessive vibration of the spring 26 due to resonance can be restricted, a fatigue resistance of the spring 26 can be enhanced.

Before the spring 26 is assembled to the housing 11, that is, when the spring 26 is in a free state, the wire 260 is formed in such a manner that the wire clearance "CL" is substantially constant. Such a spring 26 can be easily manufactured with low cost. Therefore, it is possible to reduce the manufacturing cost of the valve timing controller 10.

[Second Embodiment]

Figure 8:
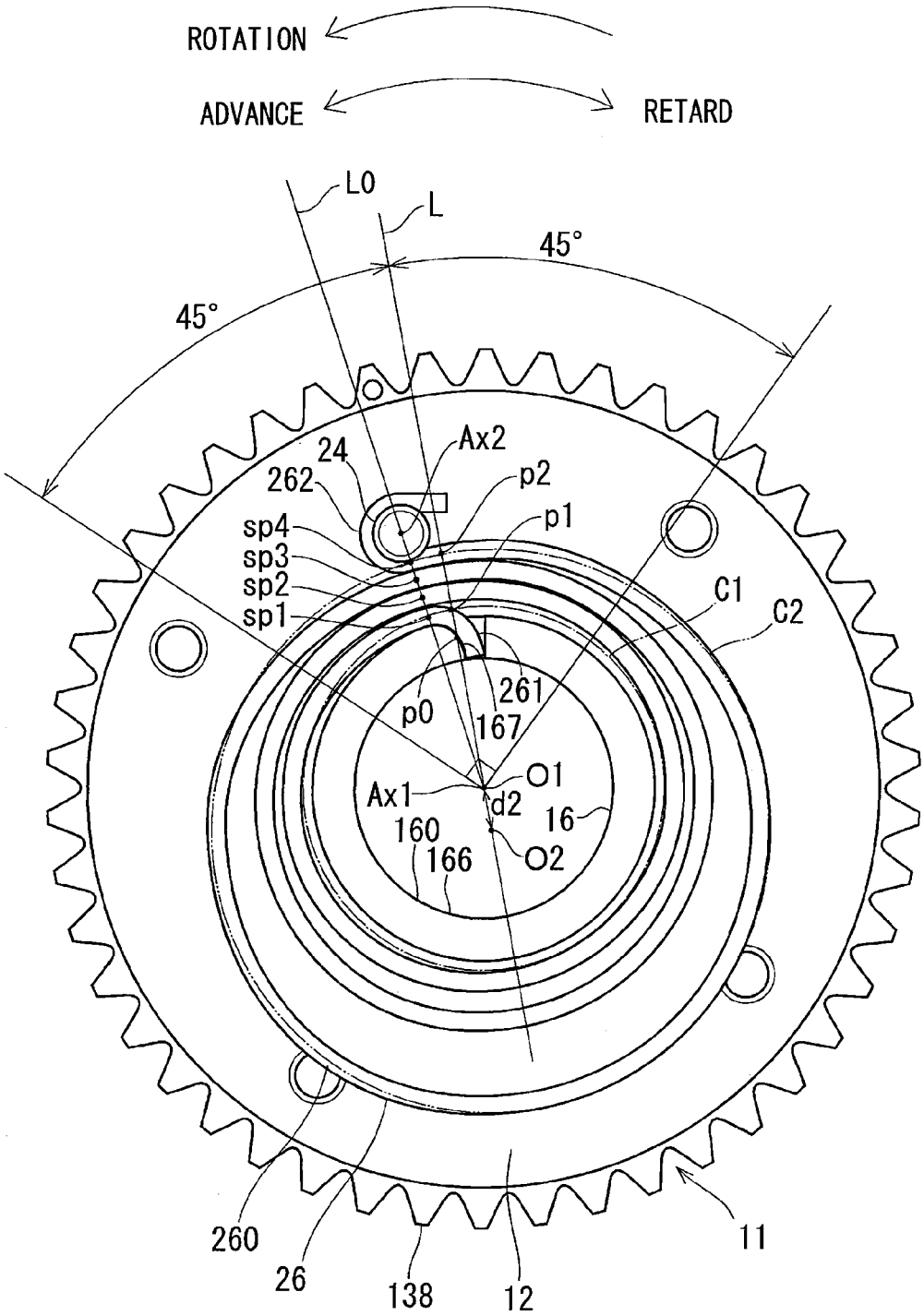
FIG. 8 is a plan view showing a valve timing controller according to a second embodiment.

Referring to FIG. 8, a second embodiment will be described. In the second embodiment, a shape of the biasing member and a position of engage portion engaged with an outer end of the biasing member are different from those in the first embodiment.

A total length of the wire 260 of the spring 26 is made shorter than that in the first embodiment. A position of the engage pin 24 is different from that in the first embodiment. As shown in FIG. 8, the inner end 261 and the outer end 262 are respectively engaged with the engage groove 167 and the engage pin 24 in such a manner that the center "O2" is apart from the center "O1" and the point "P0", whereby the circle "C2" is eccentric to the circle "C1" by a specified amount "d2" The engaging pin 24 is located at a vicinity of the line "L" in the winding direction. In the present embodiment, the engage pin 24 is located at a position where its axis "Ax2" intersects the line "L0".

FIG. 8 shows a situation where the vane 161 is in contact with the stopper surface 135. That is, the vane rotor 16 is most advanced. In this situation, the specified points "sp1", "sp2", "sp3" and "sp4" and the engage pin 24 are aligned radially outwardly with respect to the boss portion 160. That is, the engage groove 167 and the inner end 261 of the spring 26 are located at a vicinity of the specified points "sp1", "sp2", "sp3" and "sp4", and the specified points "sp1", "sp2", "sp3" and "sp4" are located at a vicinity of the engage pin 24.

Moreover, the clearance gaps between the points "sp1", "sp2", "sp3" and "sp4" of the wire 260 are substantially zero. That is, in the spiral spring 26, the wire 260 is lightly contact with each other at the points "sp1", "sp2", "sp3" and "sp4". The above eccentric amount "d2" is defined so that the wire 260 is lightly contact with each other at the points "sp1", "sp2", "sp3" and "sp4". Furthermore, according to the present embodiment, the points "sp1", "sp2", "sp3" and "sp4" of the wire 260 are sandwiched between the extended portion 166 and the engage pin 24.

According to the present embodiment, while the valve timing controller 10 is operated, that is, while the vane rotor 16 rotates relative to the housing 11, the engage groove 167 and the inner end 261 of the spring 26 are always positioned at a vicinity of the specified points "sp1", "sp2", "sp3" and "sp4" and the engage pin 24. Therefore, even if a centrifugal force is applied to the inner end 261 of the spring 26, the inner end 261 is hardly displaced by the wire 260 at the specified points "sp1", "sp2", "sp3" and "sp4" and the engage pin 24. It can be restricted that the inner end 261 of the spring 26 is disengaged from the engage groove 167 and the inner end 261 is radially outwardly displaced.

Furthermore, according to the present embodiment, the wire 260 of the spring 26 is lightly contact with each other at the points "sp1" to "sp4", and the specified points "sp1" to "sp4" are aligned with the engage pin 24. Thus, the displacement of the inner end 261 can be effectively restricted and an excessive vibration of the spring 26 due to resonance can be restricted.

As described above, according to the present embodiment, the engaging pin 24 is located at a vicinity of the line "L" in the winding direction of the wire 260. Therefore, the engage groove 167 and the inner end 261 of the spring 26 are located at a vicinity of the specified points "sp1" to "sp4", and the specified points "sp1" to "sp4" are located at a vicinity of the engage pin 24. Even if the wire 26 at the specified points "sp1" to "sp4" receives a force from the inner end 261 radially outwardly, the displacement of the wire 260 at the specified points "sp1" to "sp4" is restricted by the engage pin 24. That is, the engage pin 24 functions also a retainer of the inner end 261 of the spring 26. Therefore, the disengagement and displacement of the inner end 261 of the spring 26 is further restricted.

[Other Embodiment]

In the above embodiments, the spring 26 is provided to the rear plate 12. However, the spring 26 may be provided to the front plate 14. The wire 260 of the spring 26 may have circular cross section.

As long as the circle "C2" is eccentric to the circle "C1", the differential angle between the line "L0" and the line "L" can be established at any degree. In the embodiments shown in FIGS. 7 and 8, the maximum differential angle is 45°.

In the above embodiments, the clearance gaps between the points "sp1", "sp2", "sp3" and "sp4" of the wire 260 are substantially zero. However, as long as the clearance gap is less than a specified value, the clearance gap is not always zero. That is, it is not always that the points "sp1" to "sp4" are in lightly contact with each other.

In the above embodiments, when the spring 26 is in a free state, the clearance "CL" of the wire 260 is substantially constant from its inner end 261 to its outer end 262. Meanwhile, the clearance "CL" may be not always constant.

In the above embodiments, the outer end 262 of the spring 26 is engaged with the engage pin. However, the outer end 262 may be engaged with a groove instead of the engage pin 24. Also, the spring 26 may bias the vane rotor 16 in the retard direction.

In the above embodiments, when the engine is started, the vane rotor 16 is positioned at the most advance position. However, when the engine is started, the vane rotor 16 may be positioned at the most retard position or a middle position between the most advance position and the most retard position. Besides, the valve timing controller may be not provided with a stopper pin.

The valve timing controller can be used for adjusting the valve timing of an intake valve.

The present invention is not limited to the embodiments mentioned above, and can be applied to various embodiments.

What is claimed is:

1. A valve timing controller provided in a driving force transmitting system in which a driving force of an internal combustion engine is transmitted from a driving shaft to a driven shaft, the valve timing controller adjusting a valve timing of an intake valve and/or an exhaust valve of an internal combustion engine, comprising:

a housing which includes: a cylindrical portion; plate portions closing both ends of the cylindrical portion; and an engaging portion provided to one of the plate portions, wherein the plate portions and the cylindrical portion define accommodation chambers in a circumferential direction of the cylindrical portion, the housing rotating along with one of the driving shaft and the driven shaft around a center axis of the cylindrical portion;

a vane rotor which includes: a cylindrical boss portion accommodated in the housing; a plurality of vanes protruding radially outwardly from the boss portion for dividing each of the accommodation chambers into a retard chamber and an advance chamber; and an engage groove formed on the boss portion in such a manner as to extend radially outwardly, the vane rotor rotating along with the other of the driving shaft and the driven shaft around a center axis of the cylindrical portion in a retard direction or an advance direction relative to the housing according to a hydraulic pressure in the retard chamber and the advance chamber; and a biasing member which is formed by winding a wire spirally and is fixed on one of the plate portions in such a manner that its inner end is engaged with the engage groove and its outer end is engaged with the engaging portion, whereby the vane rotor is biased in the advance direction or the retard direction relative to the housing, wherein:

in a case that a most inner imaginary circle passing through a most inner center line at point p1 of the wire is denoted by C1, a most outer imaginary circle passing through a most outer center line at point p2 of the wire is denoted by C2, a center of the imaginary circle C1 is denoted by O1, a center of the imaginary circle C2 is denoted by O2, a contact point between the inner end and the engage groove is denoted by p0, a first imaginary line passing through the center O1 and the points p0, p1, and p2 is denoted by line L, specified points sp1, sp2, sp3, and sp4 are defined in a winding direction of the wire, and a second imaginary line passing through the center O1, and the specified points sp1, sp2, sp3, and sp4 is denoted by line L0, the inner end and the outer end are respectively engaged with the engage groove and the engaging portion in such a manner that the center O2 is apart from both the center O1 and the point p0 on the first imaginary line L, whereby the circle C2 is eccentric to the circle C1 by a specified amount that is established so that a clearance of the wire between specified points sp1, sp2, sp3, and sp4 of the wire on the second imaginary line L0 is zero, wherein each of the specified points sp1, sp2, sp3, and sp4 of the wire is at the intersection of the wire and the second imaginary line L0.

2. A valve timing controller according to claim 1, wherein the engaging portion is an engage pin protruding from one of the plate portions in a direction opposite to the cylindrical portion; and the engage pin is located at a vicinity of the first imaginary line L in a winding direction of the wire.

3. A valve timing controller according to claim 1, wherein when the biasing member is in a free state in which the inner end and the outer end are not engaged with the engage groove and the engaging portion respectively, a wire clearance is substantially constant from the inner end to the outer end in a spiral direction of the wire.

* * * * *